US008721799B2

(12) United States Patent
Dalsing et al.

(10) Patent No.: US 8,721,799 B2
(45) Date of Patent: May 13, 2014

(54) DISHWASHER APPLIANCE, AND ASSOCIATED METHOD

(75) Inventors: Troy Dalsing, Kinston, NC (US); Michael Bryan Pike, Kinston, NC (US); Jason Duckworth, Kinston, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 755 days.

(21) Appl. No.: 12/492,465

(22) Filed: Jun. 26, 2009

(65) Prior Publication Data

US 2010/0326471 A1 Dec. 30, 2010

(51) Int. Cl.
*B08B 7/04* (2006.01)

(52) U.S. Cl.
USPC ..... 134/18; 134/25.2; 134/34

(58) Field of Classification Search
None
See application file for complete search history.

(56) References Cited

U.S. PATENT DOCUMENTS

| | | | |
|---|---|---|---|
| 4,106,517 | A | 8/1978 | Wright |
| 5,771,909 | A | 6/1998 | Hein et al. |
| 7,110,832 | B2 | 9/2006 | Ghent |
| 7,371,288 | B2 | 5/2008 | Cho et al. |
| 2005/0126602 | A1 | 6/2005 | Rosenbauer |
| 2006/0156764 | A1 | 7/2006 | Baggio et al. |
| 2007/0119478 | A1 | 5/2007 | King et al. |
| 2007/0246073 | A1 | 10/2007 | Kang |

FOREIGN PATENT DOCUMENTS

| | | | |
|---|---|---|---|
| DE | 19650915 | A1 | 1/1998 |
| DE | 198 02 865 | A1 | 7/1999 |
| DE | 199 57 248 | A1 | 5/2001 |
| EP | 1 683 902 | A1 | 7/2006 |
| WO | WO 2006/087735 | A1 | 8/2006 |
| WO | WO 2007/074022 | A1 | 7/2007 |
| WO | WO 2008/017910 | A2 | 2/2008 |
| WO | WO 2009/056278 | A1 | 5/2009 |
| WO | WO 2009/080770 | A1 | 7/2009 |
| WO | WO 2010/057827 | A1 | 5/2010 |

OTHER PUBLICATIONS

International Search Report and Written Opinion for Application No. PCT/US2010/039465 dated Oct. 20, 2010.
Office Action for Chinese Application No. 201080033612.0; dated Nov. 8, 2013.

*Primary Examiner* — Eric Golightly
(74) *Attorney, Agent, or Firm* — Alston & Bird LLP

(57) ABSTRACT

A method for controlling and monitoring operation of a dishwasher appliance is provided and includes directing a first automatic wash cycle within a series of automatic wash cycles to be executed by the dishwasher appliance with a control device associated therewith. Each wash cycle is configured to have an increased energy usage level over a previous automatic wash cycle, and the energy usage level for each wash cycle is determined from at least one operational parameter associated with each respective automatic wash cycle. The method further includes directing a second automatic wash cycle, following the first automatic wash cycle, to be executed by the dishwasher appliance with the control device in response to a selection with an actuator device operably engaged with the control device. The selection may be based on a cleanliness evaluation of dishware washed by the dishwasher appliance.

7 Claims, 5 Drawing Sheets

DISHWASHER APPLIANCE, AND ASSOCIATED METHOD

BACKGROUND OF THE INVENTION

1. Field of the Invention

Aspects of the present disclosure are directed to dishwashing appliances and, more particularly, to a dishwasher appliance and an associated method for interacting with a user with regard to controlling and monitoring operation of the dishwasher appliance.

2. Description of Related Art

There is generally a growing societal concern about the environmental impact (i.e., energy usage) of everyday activities, such as operating a dishwasher. That is, there is a continuing demand for increased energy efficiency in appliances, often reflected in industry certifications. As such, water and power conservation are often issues associated with appliances, such as dishwashers. For example, the amount of water circulated through the dishwasher during the wash cycle may directly affect the electrical energy used by the dishwasher (i.e., for heating the water, operating the pump(s), etc.), as well as the water consumption thereof. However, each household/consumer provides a unique challenge in maximizing energy efficiency with respect to a dishwasher, while still meeting the particular needs/preferences of the household/consumer. That is, the consumer base presents a multitude of variables that may have to be addressed in evaluating the performance of the dishwasher, such as types of food left on the dishes, the family or household size, the quality of the pre-wash before loading the dishes, and the level of environmental consciousness of the consumer.

Thus, there exists a need for an apparatus and method for controlling and monitoring the energy usage of a dishwasher, in some instances, by allowing a user to make a conscious subsequent wash cycle selection based upon efficiency parameters such as "green" values, outlook on the environment, particular eating habits, family/household size, and dishwasher loading variations, in comparison to the user's subjective evaluation of the cleanliness level of the dishware attained in the previous wash cycle.

BRIEF SUMMARY OF THE INVENTION

The above and other needs are met by the present disclosure which, in one embodiment, provides a dishwasher appliance adapted for interaction with a user with regard to controlling and monitoring operation of the dishwasher appliance. The dishwasher comprises a control device configured to direct one of a series of automatic wash cycles to be executed by the dishwasher appliance. Each successive automatic wash cycle within the series has an increased energy usage level over a previous automatic wash cycle, wherein each energy usage level is determined from at least one operational parameter associated with the respective automatic wash cycle. An actuator device is operably engaged with the control device. The actuator device is configured to be responsive to the user to select a subsequent automatic wash cycle to be executed by the dishwasher appliance as directed by the control device, wherein the subsequent automatic wash cycle comprises one of a previous automatic wash cycle and a successive automatic wash cycle in the series of automatic wash cycles, with respect to the one of the series of automatic wash cycles. The user is thereby capable of selecting the subsequent automatic wash cycle to be executed by the dishwasher appliance, and the energy usage level associated therewith, following the one of the series of automatic wash cycles, at least partially based on a cleanliness evaluation of dishware washed by the dishwasher appliance in the one of the series of automatic wash cycles.

Another advantageous aspect of the present invention comprises a method for controlling and monitoring operation of a dishwasher appliance. Such a method comprises directing one of a series of automatic wash cycles to be executed by the dishwasher appliance with a control device associated therewith, wherein each successive automatic wash cycle within the series has an increased energy usage level over a previous automatic wash cycle. The method further comprises selecting a subsequent automatic wash cycle to be executed by the dishwasher appliance as directed by the control device, and the energy usage level associated therewith, with an actuator device operably engaged with the control device and configured to direct the selection thereto. The subsequent automatic wash cycle comprises one of a previous automatic wash cycle and a successive automatic wash cycle in the series of automatic wash cycles, with respect to the one of the series of automatic wash cycles, and following the one of the series of automatic wash cycles, wherein the selection is at least partially based on a cleanliness evaluation of dishware washed by the dishwasher appliance in the one of the series of automatic wash cycles.

Thus, the control device and associated method provide advantages that may include, but are not limited to, providing a controlling and monitoring procedure for the dishwasher appliance, in some instances, by allowing a user to make a conscious subsequent wash cycle selection based upon efficiency parameters such as "green" values, outlook on the environment, particular eating habits, family/household size, and dishwasher loading variations, in comparison to the user's subjective evaluation of the cleanliness level of the dishware attained in the previous wash cycle.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE INVENTION

The present disclosure now will be described more fully hereinafter with reference to the accompanying drawings, in which some, but not all embodiments of the disclosure are shown. Indeed, this disclosure may be embodied in many different forms and should not be construed as limited to the embodiments set forth herein; rather, these embodiments are provided so that this disclosure will satisfy applicable legal requirements. Like numbers refer to like elements throughout.

Figure 1:
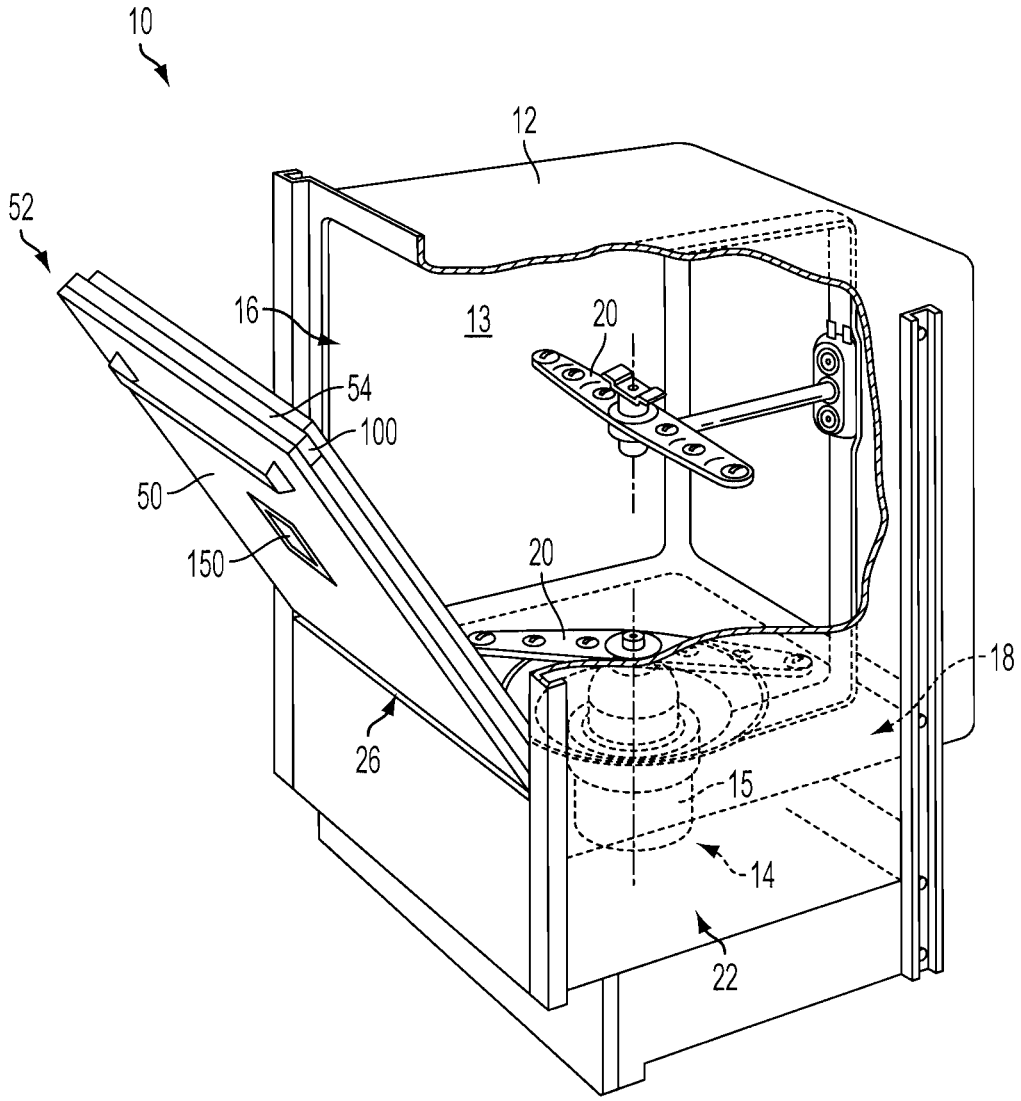
FIG. 1 is a perspective view of a dishwashing appliance capable of implementing various embodiments of the present disclosure.
Figure 2:
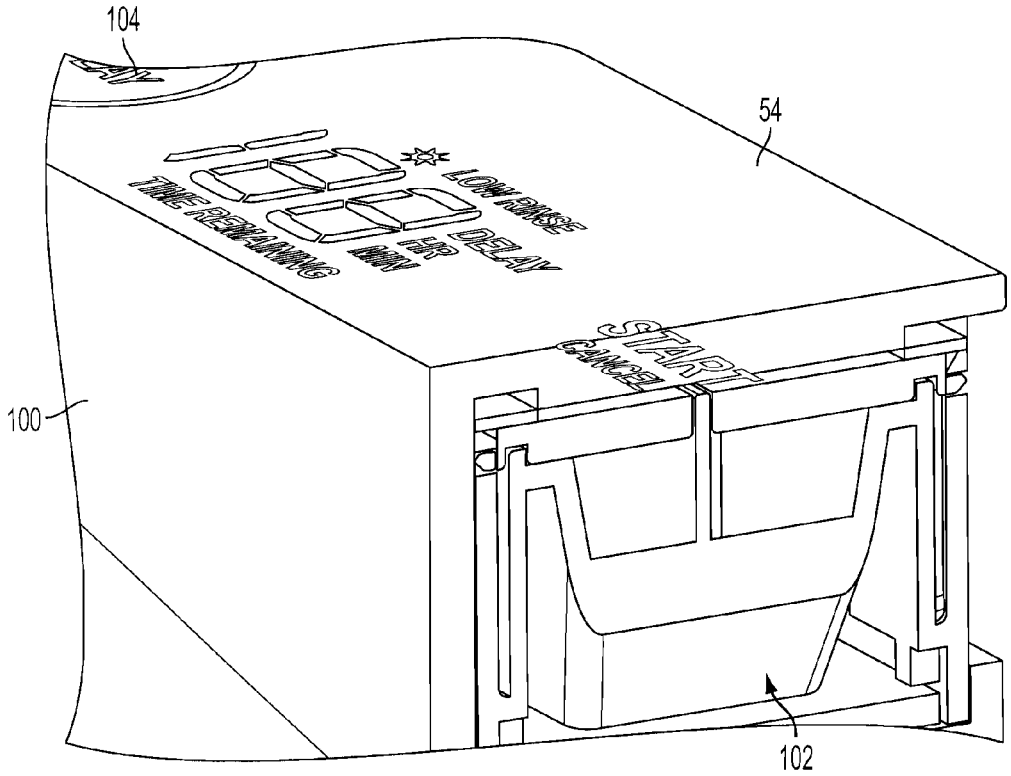
FIG. 2 is a cross-sectional view of control panel for a dishwashing appliance, the control panel having a control device in accordance with one embodiment of the present invention.
Figure 3:
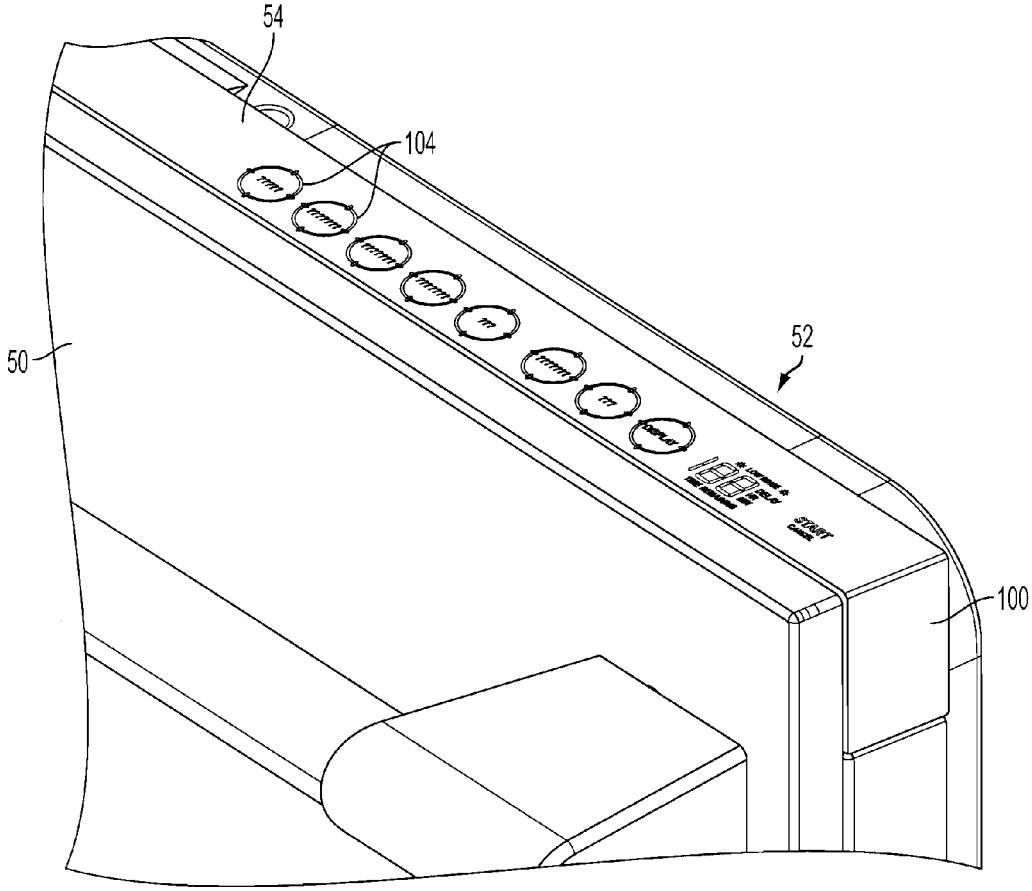
FIG. 3 is a partial perspective view of a door assembly for a dishwashing appliance, the door assembly including a control device operably engaged with an actuator device accessible about an upper surface of the door assembly, according to one embodiment of the present invention.

FIG. 1 illustrates one example of a dishwasher 10 capable of implementing various embodiments of the present invention. Such a dishwasher 10 typically includes a tub portion 12 (partly broken away in FIG. 1 to show internal details) having a plurality of walls (e.g., side wall 13) for forming an enclosure in which dishes, utensils, and other dishware may be placed for washing. The tub portion 12 may also define a forward access opening, generally designated as 16. As known in the art, the dishwasher 10 may also include slidable bottom and upper racks (not shown) for holding the dishes, utensils, and dishware. A door assembly 50 may be pivotably engaged with the tub portion 12 about the lower end 18 thereof so as to selectively permit access to the interior of the tub portion 12. That is, a lower edge 26 of the door assembly 50 may be pivotably engaged (i.e., hinged) with the lower end 18 of the tub portion 12 such that the door assembly 50 is pivotable about the lower edge 26 thereof to provide access to the interior of the tub portion 12 through the forward access opening 16, and to cover and seal the forward access opening 16 when the dishwasher 10 is in operation.

The tub portion 12 may define a sump assembly, generally designated as 14, in which wash water or rinse water is collected, typically under the influence of gravity, wherein the sump assembly 14 may cooperate with a bottom wall 17 to enclose the dishwasher about the lower end 18 of the tub portion 12. The wash/rinse water may be pumped by a pump 15 out of the sump assembly 14 to various spray arms 20 mounted in the interior of the tub portion 12 for spraying the wash/rinse water, under pressure, onto the dishes, utensils, and other dishware contained therein. The dishwashing fluid collected in the sump assembly 14 is re-circulated through the spray arm(s) 20 during each of the wash and rinse cycles typically implemented by the dishwasher 10. The pump 15 and/or other operational components (e.g., circulation pump, drain pump, water valve) may be housed, disposed, or otherwise positioned within a base portion/component 22 positioned beneath the tub portion 12, wherein the base portion 22 receives and supports the lower end 18 of the tub portion 12. In some instances, the base portion 22 may be a separate component with respect to the tub portion 12, such as, for example, a molded polymer component, while in other instances the base portion 22 may be integral with the tub portion 12 such that the side walls forming the tub portion 12 also at least partially form the base portion 22.

The dishwasher 10 may include a control panel 100 having a control device 102 configured to direct the operation/actuation of various operational components of the dishwasher 10. The control device 102 may include, for example, a circuit board, a timer device or other control unit (for controlling certain aspects/operations of the dishwasher 10) that is otherwise in communication with one or more actuator devices 104 and/or user interfaces, which may be mounted in/on the control panel 100/door assembly 50 of the dishwasher 10 or otherwise associated with the door assembly 50. The control device 102 may further be in communication, via a wiring arrangement (not shown), such as, for example, a wiring harness, with various operational components (e.g., circulation pump, drain pump, water valve, water heater) of the dishwasher 10, wherein such operational components may thus be controlled by the control device 102, upon initiation of the actuator devices 104 and/or user interfaces associated with the door assembly 50. In some instances, the control panel 100/control device 102 may be mounted or otherwise secured to the door assembly 50 about an upper end 52 defined thereby, wherein the control actuators 104 are accessible via the upper surface 54 of the control panel 100.

The dishwasher 10 may typically include a number of selectable automatic wash cycles that are configured to adjust various parameters of the dishwashing process for a particular wash cycle segment/event. Depending on the nature of the load, a user may select, for example, "extreme," "heavy," or "normal" automatic wash cycles for varying food soil levels on the dishware, a "china/crystal" automatic wash cycle, an "economy" automatic wash cycle, a "speed wash" or "light soil" automatic wash cycle, or a "rinse and hold" automatic wash cycle. Such automatic wash cycles may be selectable by the user on a display screen or touch pad disposed on or in association with the control panel 100/control device 102, which may be generally integrated into a portion of the pivotable door 50 of the dishwasher 10. In this regard, the control device 102 may be configured to facilitate varying the operational parameters of the dishwasher in accordance with the automatic wash cycle selected by the user. That is, the user selects an automatic wash cycle by, for example, pressing one of the actuator devices 104, such as, for example, a button or other input device on the touch pad (e.g., the upper surface 54) associated with the desired automatic wash cycle such that the information is transferred to the control device 102 for processing by, for instance, a microprocessor operable therewith to set the operational parameters of the various components for effectuating the selected automatic wash cycle segment/event. Accordingly, the parameters such as, for example, wash cycle duration, rinse cycle duration, water level/usage, water temperature, particular durations for each cycle segment/event (e.g., a fill event, a circulation event), other associated events (e.g., whether or not a macerator device is actuated), and combinations thereof may be adjusted and controlled by the control device 102.

Generally, the various operational parameters associated with each automatic wash cycle are pre-set with respect to the wash program utilized by the dishwasher. As such, a user may be unable to determine with accuracy the amount of energy/resources used by any of the automatic wash cycles. However, aspects of the present invention may accommodate the user determining a subjective or relative balance between the energy/resources consumed by the dishwasher and the obtained "cleanliness" of the dishware provided by the selected automatic wash cycle. More particularly, in some instances, the user's preference for or subjective evaluation of dishware cleanliness may not necessarily correspond to dishware cleanliness provided by the selected automatic wash cycle of the dishwasher. That is, the selected automatic wash cycle may not sufficiently clean the dishware (i.e., there may be apparent food soils remaining on the dishware), or may clean the dishware in excess of the user's expectations. Insufficient cleaning (not as clean as necessary or preferred) may be readily apparent. On the other hand, "excess" cleaning may be more difficult to identify and, as such, the dishwasher may be using more energy than necessary or preferred in exceeding a user-acceptable cleanliness of the dishware. Often, by the various predetermined automatic wash cycles provided (i.e., "extreme," "heavy," or "normal" automatic wash cycles for varying food soil levels on the dishware, a "china/crystal" automatic wash cycle, an "economy" automatic wash cycle, a "speed wash" or "light soil" automatic wash cycle, or a "rinse and hold" automatic wash cycle) with the dishwasher 10, the user may be able to change the selected cycle, as necessary, to obtain the desired level of cleanliness.

However, in doing so, the user may be unable to determine the relative energy/resource use between the various cycles of the dishwasher 10.

Figure 4:
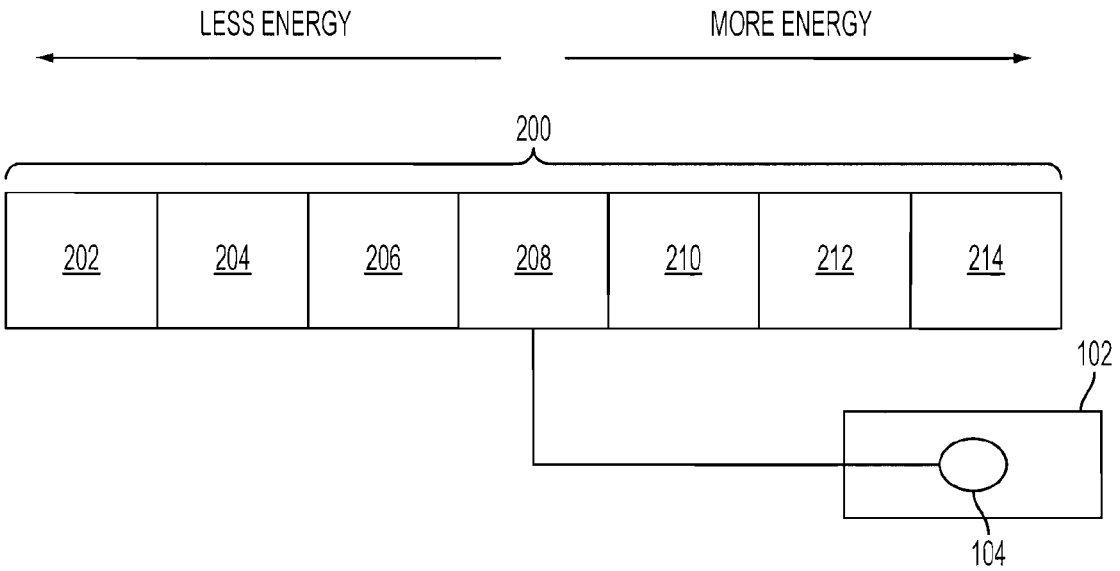
FIG. 4 illustrates one embodiment according to the present disclosure of a series of automatic wash cycles selectable according to energy usage levels.

Accordingly, as shown in FIG. 4, the control device 102 may be configured to direct a series of automatic wash cycles 200, each having a particular sequence and duration of cycle segments/events, but with each automatic wash cycle 200 being configured to be differentiated from the previous (or subsequent) automatic wash cycle in the series according to, for example, the associated energy/resource consumption level. In some instances, the energy/resource consumption level associated with each automatic wash cycle 200 may be further associated, for example, with a particular cleanliness of the dishware (i.e., each subsequent automatic wash program in the series represents an incremental increase in dishware cleanliness). In doing so, the operational parameters associated with each automatic wash cycle 200 may be configured to correspond to a particular energy/resource usage or consumption. Thus, while an automatic wash cycle 200 may be initially selected by a user based on what the user deems as the appropriate automatic wash cycle 200 needed to clean the dishware (e.g., a first "estimate"), the user may then select the same or a different automatic wash cycle 200 in the series for subsequent loads, for example, based upon a subjective determination of the cleanliness of the dishware washed according to the selected automatic wash cycle 200 (i.e., whether the dishware is "clean" enough) or, for instance, a desire to regulate energy/resource consumption while obtaining sufficiently clean dishware (i.e., how much energy/resources can be conserved by selecting a lower automatic wash cycle 200 in the series, where the selected automatic wash cycle will still provide acceptably clean dishware). Accordingly, embodiments of the present invention may thus provide a method and apparatus for allowing a user to monitor and control the operation and associated environmental impact of a dishwasher, for example, to address the growing concerns of consumers who are environmentally conscious or desire to be "green." In this regard, the control device 102 may be configured, in some instances, to monitor one or more of the operational parameters corresponding to the automatic wash cycle selected from the series of automatic wash cycles 200, during operation of the dishwasher 10, and to determine the associated energy/resource usage level therefrom. In some particular instances, the actual energy/resources consumed by the selected automatic wash cycle 200 (i.e., as numbers or quantities) may be determined and displayed to the user (e.g. amount of water used during the selected automatic wash cycle 200).

More particularly, according to one aspect, a dishwasher appliance 10 may be configured to follow such a protocol in which one of the series of automatic wash cycles 200 is initially selected (e.g., by the user or as a default setting) as the appropriate automatic wash cycle 200 for evaluating dishware cleanliness versus energy/resource usage. As illustrated in FIG. 4, the series of automatic wash cycles 200 may include successive automatic wash cycles 202, 204, 206, 208, 210, 212 and 214, selectable by one or more actuator devices 104. As discussed, each automatic wash cycle within the series may be configured to have an increased energy/resource usage level over the previous automatic wash cycle in the series. In doing so, each energy/resource usage level may be determined from at least one operational parameter (e.g., wash cycle duration, rinse cycle duration, water level usage, water temperature, cycle segment/event duration, and combinations thereof) associated with the respective automatic wash cycle. In the illustrated embodiment, the leftmost automatic wash cycle 202 uses the least energy/resources of the series of automatic wash cycles 200 (relatively) due to the particular operational parameters associated therewith. Similarly, the rightmost automatic wash cycle 214 uses the most energy/resources of the series of automatic wash cycles 200 due to the operational parameters associated therewith. In this instance, the energy/resources used by each of the series of automatic wash cycles 200 progressively increases the leftmost automatic wash cycle 202 to the rightmost automatic wash cycle 214, in accordance with variations of the operational parameters associated with each respective automatic wash cycle. In this instance, one skilled in the art will appreciate that the terms "leftmost" and "rightmost" are used to merely indicate relative dispositions among the automatic wash cycles in the referenced series, and are not otherwise intended to be limiting in any respect.

According to exemplary embodiment of the present invention, the control device 102 for the dishwasher 10 may be accessible via the control panel 100 associated with the door assembly 50 of the dishwasher 10, and includes a control option (e.g., actuator devices 104) in communication with the control device 102 and responsive to the user such that the user may select from the series of automatic wash cycles 200, as previously discussed. The actuator device(s) 104 may be configured to allow the user to select an appropriate automatic wash cycle from the series of automatic wash cycles 200, as previously discussed. In some instances, the actuator device 104 may be a one or more button-type devices that is successively actuated such that the indicated selection proceeds sequentially along the series. In other instances, each automatic wash cycle may have an individual actuator device 104 or button-type device associated therewith such that the user can select a particular automatic wash cycle without proceeding sequentially along the series. Further, the actuator device 104 may be labeled or otherwise provided with an indicia indicating whether the energy/resource usage level of the dishwasher 10 is being increased or decreased. In some instances, the actuator device 104 may be subdivided such that interaction with a first portion thereof corresponds to a decreased or less energy/resource usage level selection, while interaction with a second portion corresponds to an increased or more energy/resource usage level selection.

Figure 5A:
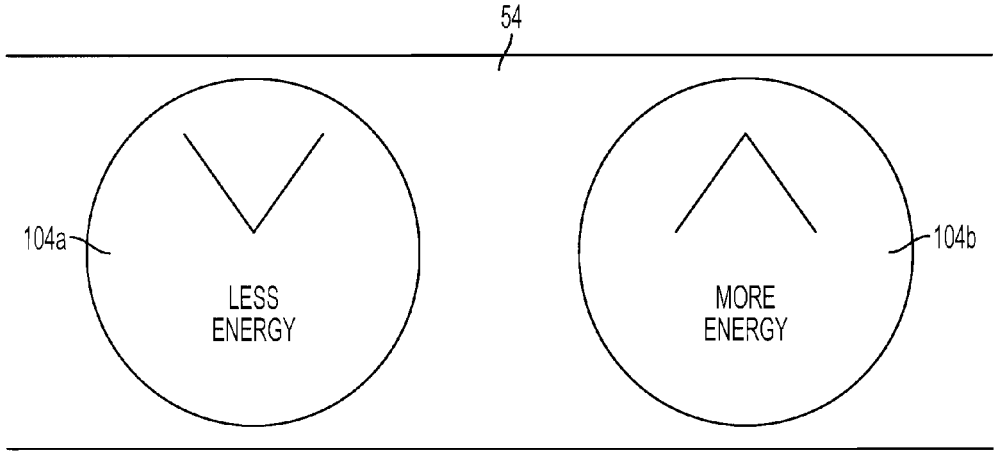
FIGS. 5A and 5B illustrate various configurations of actuator devices configured in accordance with embodiments of the present invention.
Figure 5B:
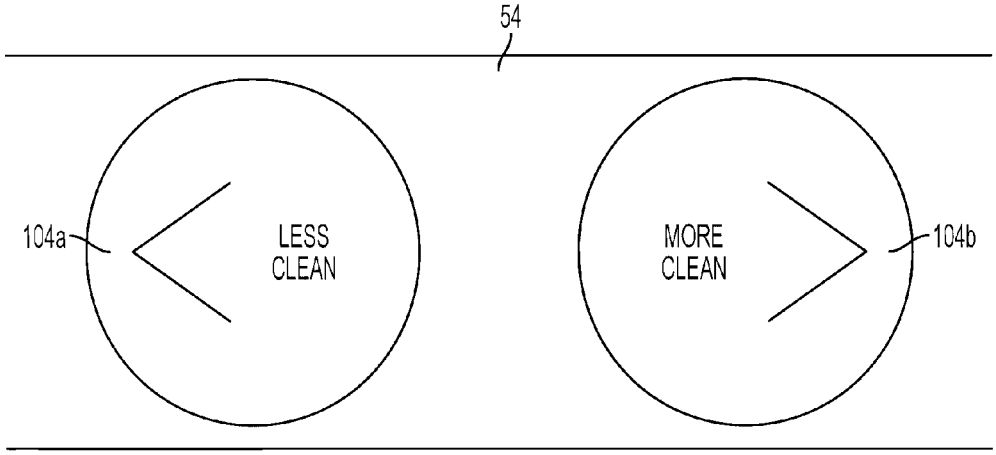

According to one particular aspect, the actuator devices 104 may include a first and second button-type device having an indicia provided thereon for indicating to the user which of the first and second button-type devices to actuate for increasing/decreasing the energy level and/or increasing/decreasing the cleanliness of the dishware. For example, as illustrated in FIG. 5A, the user interacts/presses the first button-type device 104*a* having the indicia of a downward arrow and the text "LESS ENERGY" to decrease the resources (i.e., decrease the resource usage level) allocated to the subsequent automatic wash cycle. Further, the user interacts/presses the second button-type device 104*b* having the indicia of an upward arrow and the text "MORE ENERGY" to increase the resources (i.e., increase the resource usage level) allocated to the subsequent automatic wash cycle. Of course, the indicia may include any suitable visual for assisting the user in adjusting the energy level usage and/or the cleanliness of the dishware. For example, an alternative indicia scheme is shown in FIG. 5B. In other instances, the actuator devices 104 may supplement or otherwise replace conventional wash cycle selection mechanisms. For example, in one instance, the actuator devices 104 may allow the user to directly choose one of the automatic wash cycles 200 without successively pressing a single button-type actuator device 104.

In some instances, the control device 102 may be configured, for example, to initially direct the medial automatic wash cycle 208 as a default selection. such that after completion of the medial automatic wash cycle 208 the user is able to determine whether the current dishware load has been sufficiently cleaned, based upon the user's preferences, and whether the energy usage level is satisfactory, again based upon the user's preferences. That is, if the user is satisfied with the level of cleanliness provided by the medial automatic wash cycle 208, then the user may decide to lower the energy usage of the dishwasher 10 by selecting the automatic wash cycle 206. The user may continue this process with each subsequent load of dishware by successively proceeding through the automatic wash cycles 202, 204 until a desired level of dishware cleanliness and energy usage is reached. Similarly, if the user is dissatisfied with the level of cleanliness after completion of the medial automatic wash cycle 208, the user may increase the energy usage of the dishwasher 10 by selecting any of the automatic wash cycles 210, 212, 214 until an acceptable level of cleanliness is reached.

In this manner, embodiments of the present invention may be based upon a subjective evaluation, by the user/consumer, of the cleanliness of the dishware washed in the dishwasher over an initial few loads, according to the consumer's "normal" parameters (e.g., perhaps the medial automatic wash cycle in the series). If the consumer determines that the initial loads are sufficiently clean and/or that the dishwasher 10 has consumed a reasonable amount of energy/resources, the consumer could then select (via the appropriate actuator device 104), for a subsequent load, the next successive automatic wash cycle 200 in the series indicated as using less energy/resources (i.e., less energy/resources, "less clean," and/or "more green") than the initial selection. If the results for the subsequent load are still acceptable, the consumer may again pick the next successive lower energy/resource consumption automatic wash cycle 200 in the series, and repeat the wash process for a subsequent load. If any particular selection produces an unacceptable level of dishware cleanliness, the consumer could then return to the previous automatic wash cycle 200 selection as the selection providing, for example, a suitable compromise between dishware cleanliness and energy/resource consumption. Of course, this iterative process may be repeated in the opposite direction (i.e., the next successive higher energy/resource consumption automatic wash cycle 200), if the initial dishware cleanliness results are unacceptable. In summary, this procedure can be conducted until the consumer is satisfied with the selection having the operational parameters providing acceptable dishware cleanliness balanced with energy/resource usage.

The different automatic wash cycles in the series selectable by the control device 102, in response to the increased/decreased energy/resource usage level selection by the user via the user end control (e.g., actuator device 104), could be numerous due to, for instance, a large variety of combinations of operational parameters defining each automatic wash cycle. For example, such operational parameters could vary from a 15 minute rinse (e.g., the leftmost automatic wash cycle 202) to a 2 hour 160°+ sanitize (e.g., the rightmost automatic wash cycle 214). That is, each automatic wash cycle 202, 204, 206, 208, 210, 212, 214 has particular operational parameters associated therewith varying from the other automatic wash cycles in the series, such that the automatic wash cycles 202, 204, 206, 208, 210, 212, 214 are gradated according to energy/resource usage level. Of course, one of ordinary skill in the art will recognize that any number of automatic wash cycles may be implemented, each with a different energy/resource usage level based on the operational parameters associated therewith, and the disclosed embodiments of the present invention are not limited to the finite number of automatic wash cycles described herein for exemplary purposes only.

To assist the consumer in monitoring the implications of a particular energy/resource usage level selection (i.e., the energy/resource usage level associated with the selected one of the series of automatic wash cycles 200), the dishwasher 10 may also include a display device 150 capable of providing an indicia visible to the user from the forward side of the dishwasher 10. The indicia may include one or more wash cycle parameters such as, for example, a cycle time and the determined energy/resource usage level(s) (i.e., electrical power, water) associated with the selected one of the series of automatic wash cycles 200. The display device 150 may be in communication with the control device 102 so as to be responsive to the control device 102 to display the indicia of the operational parameter(s) and the determined energy/resource usage level(s). In some instances, the display device 150 may comprise, for example, an LED display or other display type capable of depicting visual indicia. By monitoring the indicia, the consumer may be provided with an objective measure (i.e., a numerical value) of the environmental impact of the dishwasher 10 in correlation with and as a consequence of a particular automatic wash cycle selection. In this regard, embodiments of the present invention may thus allow consumers to make automatic wash cycle selections for the dishwasher 10 based upon, for instance, their "green" values, and their outlook on the environment, their particular eating habits, their family/household size, and diversity, and dishwasher loading variations. In this manner, the consumer plays a role in deciding how much their selection of an automatic wash cycle of a dishwasher impacts the environment.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for controlling and monitoring operation of a dishwasher appliance, the method comprising:

directing a first automatic wash cycle within a series of automatic wash cycles to be executed by the dishwasher appliance with a control device associated therewith, each successive automatic wash cycle within the series configured to have an increased energy usage level over a previous automatic wash cycle;

determining an energy usage level for the first automatic wash cycle from at least one operational parameter associated with the first automatic wash cycle; and directing a second automatic wash cycle, following the first automatic wash cycle, to be executed by the dishwasher appliance with the control device in response to a manual selection by a user with an actuator device operably engaged with the control device, the second automatic wash cycle comprising a preceding automatic wash cycle or a successive automatic wash cycle in the series of automatic wash cycles with respect to the first automatic wash cycle, the manual selection being at least partially based on the energy usage level and/or a cleanliness evaluation of dishware washed by the dishwasher appliance in the one of the series of automatic wash cycles.

2. A method according to claim 1 further comprising monitoring the at least one operational parameter with the control device during operation of the dishwasher appliance, and determining the associated energy usage level therefrom.

3. A method according to claim 2 further comprising displaying an indicia of the at least one operational parameter and the determined energy usage level associated therewith on a display device in communication with the control device and responsive thereto.

4. A method according to claim 3 wherein displaying an indicia further comprises displaying an indicia comprising one of a cycle time associated with the first automatic wash cycle, the determined energy usage level associated with the first automatic wash cycle, a water usage level associated with the first automatic wash cycle, and combinations thereof.

5. A method according to claim 1 wherein determining the energy usage level from at least one operational parameter further comprises determining the energy usage level from at least one operational parameter comprising at least one of a wash cycle duration, a rinse cycle duration, a drain cycle duration, a drying cycle duration, a water usage level, a water temperature, and combinations thereof.

6. A method according to claim 1, wherein determining the energy usage level from the at least one operational parameter comprises determining at least one of an electrical power usage or water usage.

7. A method for controlling and monitoring operation of a dishwasher appliance, the method comprising:

directing a first automatic wash cycle within a series of automatic wash cycles to be executed by the dishwasher appliance with a control device associated therewith, each successive automatic wash cycle within the series configured to have an increased energy usage level over a previous automatic wash cycle;

monitoring at least one operational parameter associated with the first automatic wash cycle with the control device during operation of the dishwasher appliance;

determining an energy usage level for the first automatic wash cycle based on the at least one monitored operational parameter, wherein the energy usage level is at least one of an electrical power usage or water usage; and directing a second automatic wash cycle, following the first automatic wash cycle, to be executed by the dishwasher appliance with the control device in response to a manual selection by a user with an actuator device operably engaged with the control device, the second automatic wash cycle comprising a preceding automatic wash cycle or a successive automatic wash cycle in the series of automatic wash cycles with respect to the first automatic wash cycle, the manual selection being at least partially based on the energy usage level and/or a cleanliness evaluation of dishware washed by the dishwasher appliance in the one of the series of automatic wash cycles.

* * * * *